US005093993A

United States Patent [19]

Nishiyama

[11] Patent Number: 5,093,993

[45] Date of Patent: Mar. 10, 1992

[54] BLADE CLIPPER FOR RETRACTABLE UTILITY KNIFE

[75] Inventor: Mizuhiko Nishiyama, Osaka, Japan

[73] Assignee: NT Incorporated, Osaka, Japan

[21] Appl. No.: 740,948

[22] Filed: Aug. 6, 1991

[30] Foreign Application Priority Data

Aug. 29, 1990 [JP] Japan ..... 2-91036[U]

[51] Int. Cl.[5] ..... B25F 3/00; B26B 1/00; B26B 29/00; B26B 3/08

[52] U.S. Cl. ..... 30/124; 30/125; 30/162; 30/293

[58] Field of Search ..... 30/124, 125, 128, 134, 30/255, 290, 293, 294, 329, 332, 346, 59; 33/42

[56] References Cited

U.S. PATENT DOCUMENTS

| | | | |
|---|---|---|---|
| 3,872,591 | 3/1975 | Quenot | 30/125 |
| 3,927,473 | 12/1975 | Braginetz | 30/125 |
| 4,501,069 | 2/1985 | Kohno | 30/293 |
| 4,794,692 | 1/1989 | Wang | 30/162 |
| 4,953,293 | 9/1990 | Sterlacci | 30/124 |

FOREIGN PATENT DOCUMENTS 62-593 8/1987 Japan .

*Primary Examiner*—Douglas D. Watts
*Assistant Examiner*—Paul M. Heyrana
*Attorney, Agent, or Firm*—Griffin, Branigan & Butler

[57] ABSTRACT

A utility knife (A) having a blade (C) retractable into a handle (B) is provided with a clipper (1) for clipping a dull end segment (E) from the blade along a score line. (F). The clipper includes an insertion portion (2) which may be inserted into the knife handle when the clipper is not in use, a hanger portion (3) which permits the clipper and knife to be hung on a garment pocket, and a connecting portion (4) connecting the insertion portion and hanger portion. The connecting portion includes a slit (5) for receiving the end segment of the blade and a movable means (14) permitting pivoting of a cover member (8) relative to a body member (7). The clipper is characterized in that a storage space (6) communicates with the slit (5) for storing blade segments clipped from knife blades.

8 Claims, 2 Drawing Sheets

BLADE CLIPPER FOR RETRACTABLE UTILITY KNIFE

FIELD OF THE INVENTION

The present invention relates to an improvement in clippers of the type used to clip the end segment from a segmented utility knife blade. More particularly, the invention provides a utility knife blade clipper having a storage space therein for the storage of clipped blade segments.

PRIOR ART

Japanese Utility Model Laid-open No. 62-593 discloses a retractable utility knife blade clipper having an insertion portion which may be inserted into the handle of the knife, a hanger portion for hanging the clipper and knife on a pocket or the like, a connecting portion extending between the insertion portion and the hanger portion, and a clipper slit into which a knife blade may be inserted so that the end segment of the blade may be clipped or broken off. When the cutting tip of the knife blade becomes dull, the clipper is removed from the knife handle and the end of the knife blade is inserted into the clipper slit. The clipper and knife are moved so as to apply a force against the end segment of the knife blade, thereby breaking off the end segment. The clipper as thus described has the disadvantage in that as the end segment is broken from the knife blade the broken end segment may spring out of or drop from the slit. The broken end segment is quite sharp and could injure the user. If the segment is allowed to fall to the ground it remains a potential safety hazard.

BRIEF SUMMARY OF THE INVENTION

An object of the present invention is to provide a retractable utility knife blade clipper wherein a clipped blade segment is prevented from springing from or dropping out of the clipper slit as the segment is separated from the knife blade.

A further object of the invention is to provide a retractable utility knife blade clipper comprising an insertion portion detachably received into the knife handle, a hanger portion permitting the clipper to be hung on a pocket or the like, a connecting portion connecting the insertion portion and the hang portion, and a clipper slit for clipping the end segment from the knife blade, the clipper being characterized in that it includes a clipped blade segment storage space communicating with the clipper slit.

Other objects and advantages of the invention will become obvious upon consideration of the following detailed description and the accompanying drawings.

DETAILED DESCRIPTION OF THE INVENTION

Figure 7:
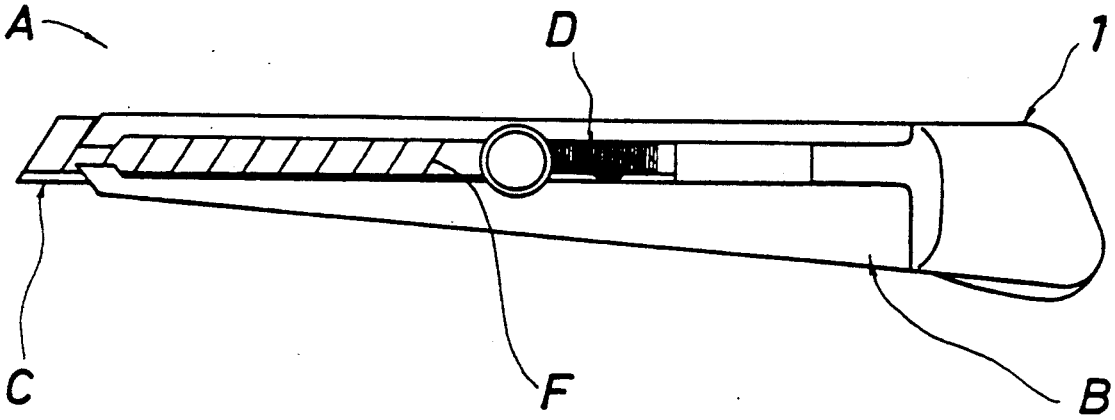

FIG. 7 shows a retractable utility knife (A) with which the clipper 1 of the present invention may be used. The knife includes a handle or hand grip (B), a blade (C), and a slider (D) slidably mounted in the handle for slidably extending the blade from, or retracting the blade into the handle. The blade (C) is diagonally scored at score lines (F) to divide the blade into a plurality of blade segments (E). When an end blade segment becomes dull or exhibits deteriorated cutting performance, the user may clip or break off the dull segment and the next segment then becomes the end segment of the blade.

Figure 5:
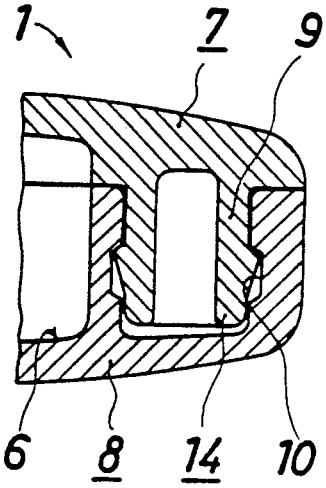
FIG. 5 is a lateral sectional view of the clipper showing the pivoting connection between a body member and a cover member.
Figure 6:
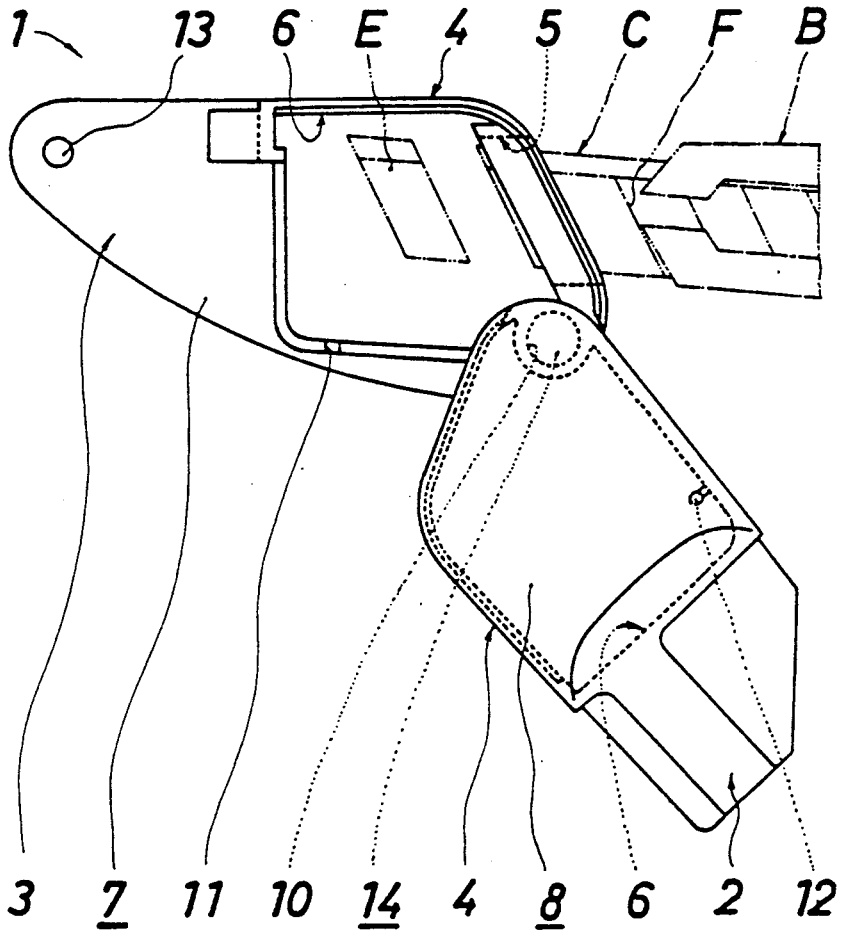
FIG. 6 is a view of the clipper with the cover member in an open position, a portion of a utility knife being shown in position for clipping an end segment from the blade; and, FIG. 7 illustrates a retractable utility knife with the clipper inserted into the knife handle.

Referring to FIGS. 1–6 a knife clipper for clipping an end segment of blade (C) comprises an insertion portion 2, a hanger portion 3, a connecting portion 4, a clipper slit 5 and a clipped blade storage space 6. In the illustrated embodiment, the storage space 6 is enclosed by a body member 7 and a cover member 8. As best shown in FIG. 5, the body member 7 is integrally molded with a support axle 9 and the cover member 8 is formed with a recess 10 for rotatably receiving axle 9. The cover member 8 may pivot about axle 9 so as to rotate relative to body member 8 so that the storage space 6 may be opened or closed.

Figure 1:
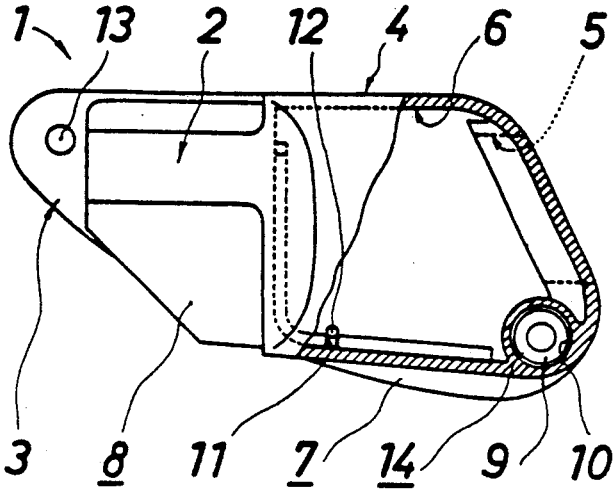
FIG. 1 is a side view, partly in section, of a retractable utility knife blade clipper constructed in accordance with the principles of the present invention.
Figure 2:
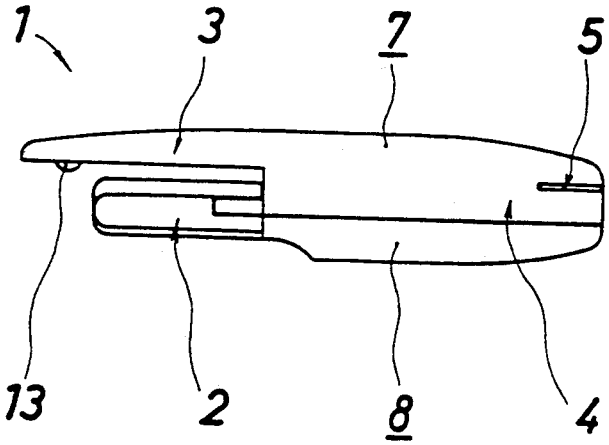
FIG. 2 is a plan view of the clipper of FIG. 1.
Figure 3:
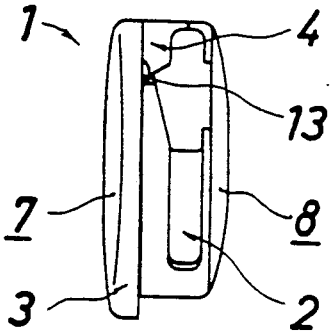
FIG. 3 is a front view of the clipper of FIG. 1.
Figure 4:
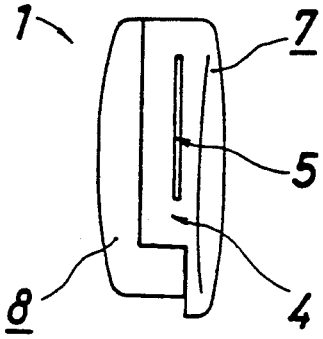
FIG. 4 is a rear view of the clipper of FIG. 1.

As shown in FIG. 1, the body member 7 is provided with a slot 11 extending across that portion **7*b* of the body member that forms a part of the bottom of the storage space 6. The cover member 8 has a laterally extending bottom wall 8*a* which is overlapped by portion 7*b* when the cover member is in its closed position. A projection 12 is integrally formed with wall 8*a* and extends upwardly from the wall and parallel to slot 11. The projection 12 may be forced into slot 11 as the cover member is rotated clockwise to close the storage space 6. The projection 12 and slot 11 thus serve as a releasable latch for holding the cover member 8** in the closed position.

The insertion portion 2 of the clipper is integrally molded with the cover member 8. In this regard, the entire clipper may be made of a synthetic resin and molded as two parts, the cover member 8 and the body member 7. The insertion portion 2 is shaped so that it may be forced by hand into the end of the utility knife handle B when the clipper is not being used. Generally speaking, the insertion portion 2 is shaped to match the opening that is present in the end of knife A. However, the insertion portion 2 is provided with recessed portions **2*a*, 2*b* leaving a raised portion 2*c*. As the clipper 1 is inserted into the handle B of the knife, the raised portion 2*c* slides between the walls of handle B that form a slot G in the front of the handle as viewed in FIG. 7. At the same time, the remainder of insertion portion 2 slides into the interior of handle B and the hanger portion 3** slides along the outer surface of the back of the handle.

The purpose of hanger portion 3 is to permit the knife A, with clipper 1 inserted therein, to be clipped or hung on a pocket or the like in the same manner as some pens and mechanical pencils. The hanger portion 3 may be integrally molded with the body member 7. A semi-hemispherical anti-slippage projection 13 is provided near the end of the hanger portion 3 on the side which faces the back of the knife handle B. As the clipper 1 is inserted into the knife handle, projection 13 slides along the back surface of the handle. When the knife is not in use, the knife may be placed in a pocket with the hanger portion 3 extending downardly on the outside of the pocket so that the material forming the pocket is clipped between hanger portion 3 and the back of knife handle B. The anti-slippage projection serves to reduce the possibility of the knife and clipper slipping out the pocket.

The connecting portion 4 pivotally connects insertion portion 2 with the hanger portion 3 via a movable means 14 which comprises axle 9 and recess 10. The connecting portion 4 has laterally extending wall members which extend from body member 7 toward cover member 8 so as to define, with the body member 7 and the cover member 8, storage space 6. A clipper slit 5 extends through one of these wall members. The wall member in which slit 5 is formed has a thickened portion 5*a* around the slit as indicated in FIG. 1. This thickened portion limits movement of a knife blade in the slit during use of the clipper as subsequently explained, thereby facilitating the breaking of the knife blade along a segment line F.

When the clipper 1 is not in use, it may be inserted in the end of knife handle B as shown in FIG. 7 and the two elements clipped to a garment pocket as previously described. When the blade C of the knife becomes dull, the clipper 1 is removed from handle B and the dull end segment of the blade is inserted into slit 5. With the end segment thus inserted, either the clipper 1 or the knife A is rotated. The thickened walls 5*a* on each side of slit 5 limit rotational movement of the end segment and a bending force is exerted against the end segment. The end segment breaks loose from the knife blade at the score line and falls into the closed space 6. The clipper 1 is then reinserted into the knife handle B and the knife is ready to use, the dull segment having been clipped off so that the next sharp segment is in position for use.

The cover member 7 is normally in the position shown in FIG. 1 and closes space 6 so that clipped blade segments are retained in the clipper. When the storage space 6 becomes filled with clipped blade segments, the cover member 7 may be rotated to the position shown in FIG. 6 so that the clipped segments may be dumped from the storage space.

While a specific preferred embodiment has been described by way of illustration, it should be understood that various modifications and substitutions may be made in the described embodiment without departing from the spirit and scope of the invention as defined by the appended claims. For example, the movable means 14 may be such as to permit pivoting of cover member 7 relative to body member 8 about a vertical axis or a lengthwise axis rather than a transverse axis as shown. If desired, the storage space 6 may be permanently closed in which case no movable means 14 is required.

I claim:

1. A retractable utility knife blade clipper of the type having an insertion portion adapted to be detachably received in a retractable utility knife handle, a hanger portion adapted to be hung on a pocket or the like, a connecting portion connecting the insertion portion and the hanger portion, and a clipper slit for clipping off an end segment of a retractable utility knife blade, said clipper being characterized in that it includes means defining a clipped blade segment storage space communicating with said clipper slit for capturing and storing clipped blade segments.

2. A retractable utility knife clipper according to claim 1 comprising a body member, a cover member, a support axle protruding from the body member, a hole in said cover member for rotatably receiving said support axle, an engagement opening provided on a lower middle portion of said body member, and an upwardly projecting engagement projection provided on a lower middle portion of said cover member for engaging said opening, said insertion portion and said cover member comprising a single piece, said hanger portion and said body member comprising a single piece, said connecting portion extending between said body member and said cover member, said clipper slit being located in the rear portion of said body member, and said clipped blade segment storage space extending between said connecting portion on the side of said body member and said connecting portion on the side of said cover member, said cover member being pivotable on said support axle between a first position whereat said storage space is closed and a second position whereat said storage space is open.

3. A retractable utility knife blade clipper comprising a body member and a cover member together defining a clipped blade segment storage space, a clipper slit formed in one of said members for receiving an end blade segment of a utility knife blade, said clipper slit communicating with said storage space whereby a blade segment clipped form a knife blade while said blade segment is in said slit is captured in said storage space; said cover member having an insertion portion receivable into an end of a utility knife handle whereby said clipper may be stored on said knife handle when said clipper is not in use.

4. A retractable utility knife blade clipper as claimed in claim 3 wherein said body member includes a hanger portion extending along a side of said knife handle when said insertion portion is inserted in said knife handle whereby said clipper and utility knife may be hung on a pocket.

5. A retractable utility knife blade clipper as claimed in claim 4 wherein a support axle is provided on one of said members and an axle receiving hole is provided on another of said members whereby said cover member may be pivoted relative to said body member to open and close said storage space.

6. A retractable utility knife blade clipper as claimed in claim 5 and further comprising releasable latch means for latching said cover member to said body member.

7. A retractable utility knife blade clipper as claimed in claim 6 wherein said latch means comprises a slot in said body member and a projection on said cover member, said projection being frictionally receivable into said slot when said cover member closes said storage space.

8. A retractable utility knife blade clipper as claimed in claim 3 wherein a support axle is provided on one of said members and an axle receiving hole is provided on another of said members whereby said cover member may be pivoted relative to said body member to open and close said storage space.

* * * * *